United States Patent [19]

Lukacik

[11] 3,948,526

[45] Apr. 6, 1976

[54] GAME APPARATUS FOR A GAME OF HANGMAN

[75] Inventor: George J. Lukacik, Jackson, N.J.

[73] Assignee: Lawrence Peska Associates, Inc., New York, N.Y. ; a part interest

[22] Filed: June 9, 1975

[21] Appl. No.: 585,361

[52] U.S. Cl. ..... 273/136 B; 273/130 E; 273/136 C; 273/136 W

[51] Int. Cl.[2] ..... A63F 3/00

[58] Field of Search ..... 273/130 R, 130 A, 130 E, 273/136 B, 136 C, 135 AD, 135 D, 136 E, 136 K, 136 W, 137 AE, 137 AC, 137 AD

[56] References Cited

UNITED STATES PATENTS

| | | | |
|---|---|---|---|
| 2,069,106 | 1/1937 | Farley | 273/136 E |
| 3,077,677 | 2/1963 | Malkin et al. | 273/130 E |
| 3,195,893 | 7/1965 | Friedman et al. | 273/130 E |
| 3,394,935 | 7/1968 | Beauchaine | 273/130 E |
| 3,734,506 | 7/1973 | Gingrass | 273/130 E |
| 3,876,207 | 4/1975 | Jones | 273/135 AD |
| D232,954 | 9/1974 | Zimmer | 273/130 E |

FOREIGN PATENTS OR APPLICATIONS

| | | | |
|---|---|---|---|
| 262,431 | 5/1964 | Netherlands | 273/130 E |

*Primary Examiner*—Anton O. Oechsle
*Assistant Examiner*—Harry G. Strappello
*Attorney, Agent, or Firm*—Richard E. Nanfeldt

[57] ABSTRACT

A game apparatus for a game of "Hangman" includes a playing board having a plurality of rows of holes in a top surface thereof. The rows of holes are adapted to receive letter pegs, wherein the unknown word is formed in one row from letter pegs stored in other rows. A pair of scaffolds are hingably mounted onto the top playing surface. A plurality of body parts are provided for forming figures on the scaffolds. The top playing surface has four square holes therein for storing the body parts and score cards therein. The top playing surface has a pair of square apertures therein for holding a piece of paper having the unknown word formed thereon.

9 Claims, 7 Drawing Figures

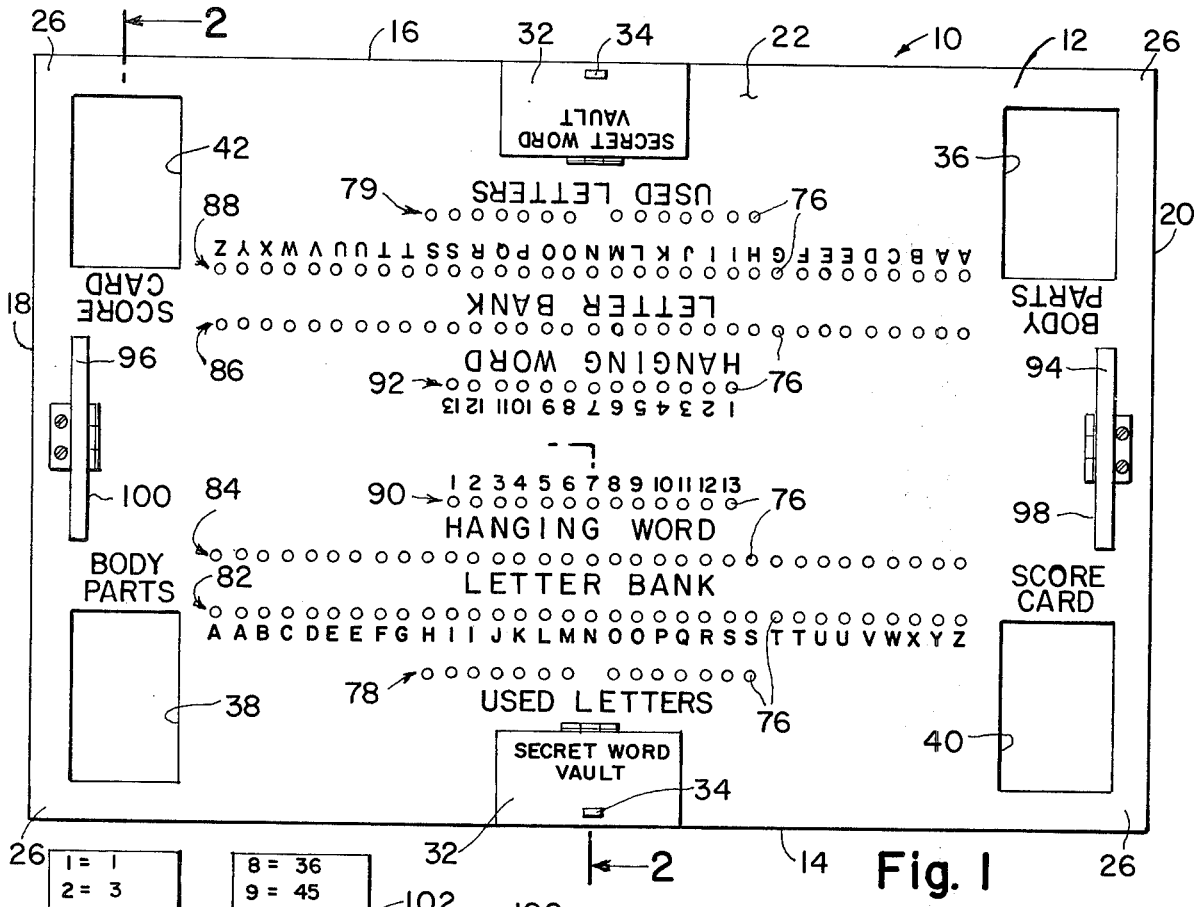
Fig. 1
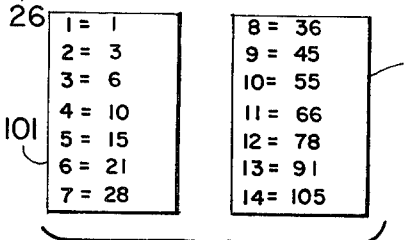
Fig. 6
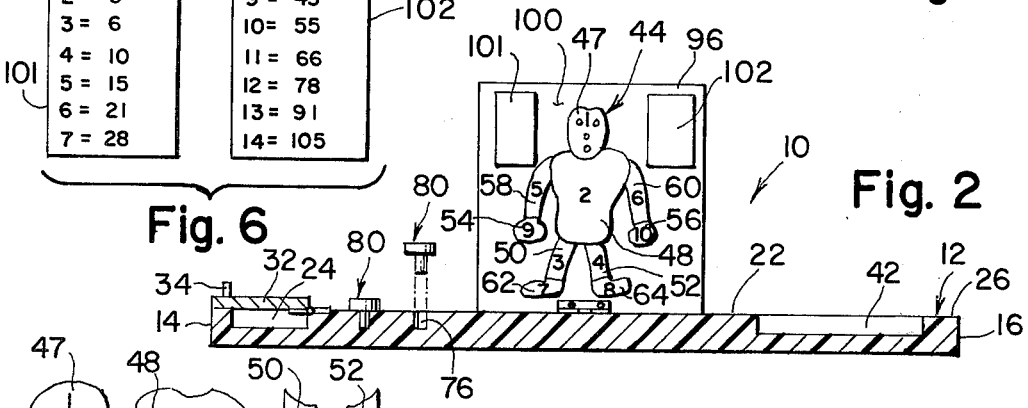
Fig. 2
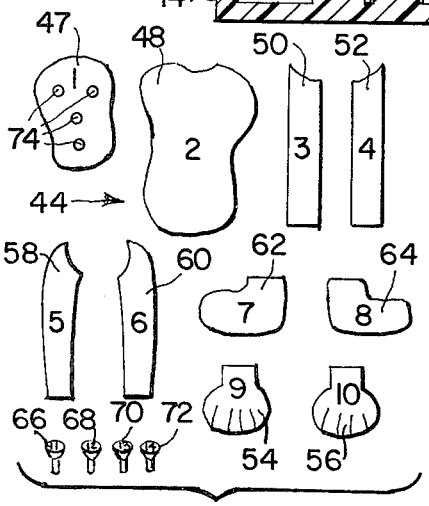
Fig. 5
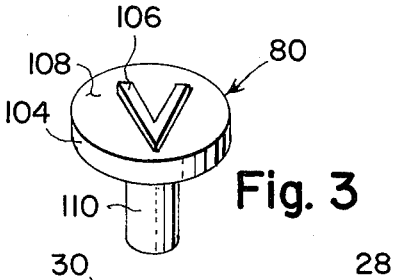
Fig. 3
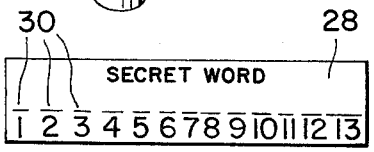
Fig. 4
| ROUND# | ME | YOU |
|---|---|---|
| 1 | | |
| 2 | | |
| 3 | | |
| 4 | | |
| TOTAL | | |
Fig. 7

GAME APPARATUS FOR A GAME OF HANGMAN

BACKGROUND OF THE INVENTION

U.S. Pat. Nos. 1,716,069; 2,456,098; 2,620,192; 3,468,540; 3,711,101; and 3,817,531 have employed various board game apparatus, but these aforementioned patents are non-applicable to my present invention.

U.S. Pat. No. 3,734,506 involves a board game apparatus for the game of hangman, but this apparatus is non-applicable to my present invention.

SUMMARY OF THE INVENTION

My present invention relates to a unique and novel board game apparatus for playing a game of Hangman.

It is an object of my present invention to provide a board apparatus for playing a game of Hangman thereon, wherein the word to be guessed is formed on the board apparatus.

A further object of my present invention is to provide a plurality of letter pegs for forming the word.

A still further object of my present invention is to provide a means for depicting a figure being hung.

Another object of my present invention is to provide a compartment for storing a piece of paper having the unknown word formed thereon.

Briefly, my present invention comprises a playing board having a plurality of rows of holes in a top surface thereof. The rows of holes are adapted to receive letter pegs, wherein the unknown word is formed in one row from letter pegs stored in other rows. A pair of scaffolds are hingably mounted onto the top playing surface. A plurality of body parts are provided for forming figures on the scaffolds. The top playing surface has four square holes therein for storing the body parts and score cards therein. The top playing surface has a pair of square apertures therein for holding a piece of paper having the unknown word formed thereon.

BRIEF DESCRIPTION OF THE DRAWINGS

The objects and features of the invention may be understood with reference to the following detailed description of an illustrative embodiment of the invention, taken together with the accompanying drawings in which:

FIG. 1 illustrates a top planar view of a game board apparatus for a game of hangman;

FIG. 2 illustrates a side cross sectional view of the apparatus taken along line 2—2 in FIG. 1;

FIG. 3 illustrates a perspective view of a letter peg;

FIG. 4 illustrates a top planar view of a card used for forming the unknown word thereon;

FIG. 5 illustrates a top planar view of the body parts;

FIG. 6 illustrates a top planar view of a pair of score conversion cards; and FIG. 7 illustrates a top planar view of a score card.

DESCRIPTION OF THE PREFERRED EMBODIMENT

Turning now descriptively to the drawings, in which similar reference characters denote similar elements throughout the several views, FIGS. 1–2 show a playing board 10 used to play a well known game of hangman between two opposing players. The playing board 10 comprises a squared shaped member 12 having front 14 and rear 16 edges, a pair of side edges 18, 20, and a top planar playing surface 22. The top playing surface 22 has at the center of edges 14, 16 rectangular shaped apertures 24 therein, wherein the apertures 24 are adapted to receive a piece of paper 28 having numbered spaces 30 thereon as shown in FIG. 4. The letters of the unknown word of the game are printed into the blanks 30. Movable panels 32, having a handle members 34, thereon are hingably mounted to the playing surface 22 such that panels 32 cover apertures 24 so as to hide paper 28 within apertures 24. Each corner 26 of the playing surface 22 has a square hole 36, 38, 40, 42 therein. One set of diagonal holes 36, 38 are adapted to receive a plurality of body parts 44 therein. The other set of diagonal holes 40, 42 are adapted to receive score cards 46 therein, wherein a typical scoring chart 101–102 is depicted in FIG. 6.

The body parts 44 have a magnetic backing, wherein the parts 44 are depicted as a head 47, a torso 48, a pair of legs 50, 52, a pair of hands 54, 56, a pair of arms 58, 60, a pair of feet 62, 64, a nose 66, a pair of eyes 68, 70 and a mouth 72, wherein the nose 66, eyes 68, 70, and mouth 72 are detachably mounted into four holes 74 contained in the face of the head 47. Each body part 44 has a number printed thereon, wherein the number on the body parts 44 corresponds to the scoring chart 101–102 in FIG. 6.

Referring back to FIGS. 1, 2 the playing surface 22 has a plurality of circular peg holes 76 aligned in rows, wherein the rows are aligned parallel to edges 14, 16. The rows are as follows as arranged from the front 14 to the rear 16 edges. The first 78 and eight 79 rows of holes 76 are 14 in number and are used for retaining letter pegs 80 that are not used to form the unknown word on paper 28. The second 82, third 84, sixth 86, and seventh 88 rows are used to hold the letter pegs 80 to be used during the game. Each row 82, 84, 86, 88 is formed from 33 holes 76. The letter pegs 80 contained in each row 82, 84, 86, 88 includes: A, A, B, C, D, E, E, F, G, H, I, I, J, K, L, M, N, O, O, P, Q, R, S, S, T, T, U, U, V, W, X, Y, Z. The fourth 90 and fifth 92 rows each contain 13 holes 76. The holes 76 of rows 90, 92 are numbered so as to correspond to the numbers of the blanks 30 on the piece of paper 28. Rectangular boards, 94, 96 having metallic surfaces 98, 100 on each side thereof are hingably mounted onto the playing surface 22 at the center of each side edge 18, 20. Each rectangular board 94, 96 serves as a scaffold, wherein the body parts 44 magnetically mount onto the metallic surfaces 98, 100. A pair of score conversion cards 101, 102 mount onto each board 94, 96. The two cards 101, 102 have numbers equated to point values such as 1=1, 2=3, 3=6, 4=10, 5=15, 6=21, 7=28, 8=36, 9=45, 10=55, 11=66, 12=78, 13=91, and 14=105 as shown in FIG. 6.

Each letter peg 80 comprises an upper disc section 104 having a raised letter 106 contained on the upper surface 108 of the section 104. A cylindrical rod section 110 extends downwardly from the section 104. Section 110 inserts into the holes 76 in the top playing surface 22.

The game is played as follows:

A first player selects a word and writes the letters of the word into the blanks 30 on the piece of paper 28 which is placed in aperture 24. A second player calls out letters that he thinks might be in the unknown word. If he guesses the letter correctly he moves the appropriate letter peg 80 from row 82, 84, 86, 88 to its correct location as indicated on paper 28 to row 90, 92 wherein the word is being formed. If the wrong letter is guessed, the player moves the appropriate letter peg 80 from rows 82, 84, 86, 88, to row 78, 79, wherein wrong letters are retained. Additionally, the player places a body part 44 on the scaffold starting with the head 47 and working down the body for each wrong guess. When all fourteen body parts 44 are placed on the scaffold the player is considered to be hung and is declared the loser. If the player forms the word his point value is taken from cards 101, 102 and enter onto the score card 46. A player that is hung receives a point value of 105. The player with the lowest point value after a given number of rounds is declared the winner.

Since obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desire to secure by Letters Patent of the United States is:

1. A game apparatus for the game of hangman, which comprises:

a. a playing board having a top playing surface, said top playing surface having at each corner thereof square holes therein, at a center of two sides square apertures therein, and a plurality of rows of holes therein;

b. a pair of scaffold members hingably joined to said top playing surface;

c. a plurality of letter pegs adapted to be inserted into said holes; and d. a plurality of body members having means thereon for detachably mounting onto said scaffold members.

2. A game apparatus according to claim 1, wherein each said scaffold member is formed from a rectangularly shaped board having a metallic surface thereon.

3. A game apparatus according to claim 1, wherein movable panels are hingably mounted onto said top playing surface across each said square aperture.

4. A game apparatus according to claim 1, wherein said body members are a head, a torso, a pair of arms, a pair of hands, a pair of legs, a pair of feet, a mouth, a nose, and a pair of eyes.

5. A game apparatus according to claim 1, wherein each said body part has a magnetic backing thereon.

6. A game apparatus according to claim 1, wherein said game apparatus further includes score cards and score conversion cards.

7. A game apparatus according to claim 3, wherein a handle member is affixed onto each said movable panel.

8. A game apparatus according to claim 1, wherein there are eight said rows of said holes.

9. A game apparatus according to claim 1, wherein each said letter peg comprises:

a. a cylindrical disc section having a raised letter on a top surface of said disc section; and b. a rod section extending downwardly from disc section, said rod section adapted to be received in one of said holes.

* * * * *